US006995785B2

(12) United States Patent
Sasaki

(10) Patent No.: US 6,995,785 B2
(45) Date of Patent: Feb. 7, 2006

(54) RECORDING METHOD AND RECORDING APPARATUS UTILIZING LASER FOCUSING ELEMENT

(75) Inventor: Yoshiharu Sasaki, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 258 days.

(21) Appl. No.: 10/452,717

(22) Filed: Jun. 3, 2003

(65) Prior Publication Data

US 2004/0012666 A1 Jan. 22, 2004

(30) Foreign Application Priority Data

Jun. 5, 2002 (JP) ..... 2002-164420

(51) Int. Cl.
*B41J 2/435* (2006.01)

(52) U.S. Cl. ..... 347/248; 347/234

(58) Field of Classification Search ..... 250/201.2, 250/206.1–206.3, 548, 201.4, 201.5; 347/234, 347/241, 242, 248, 256–257, 116; 356/624, 356/609; 382/255; 396/79–80
See application file for complete search history.

(56) References Cited

U.S. PATENT DOCUMENTS 5,212,500 A * 5/1993 Harrigan et al. ..... 347/241
6,621,060 B1 * 9/2003 Nantel et al. ..... 250/201.4

FOREIGN PATENT DOCUMENTS

JP A 203-72123 3/2003
JP A 2003-72119 3/2003

* cited by examiner

*Primary Examiner*—Hai Pham
(74) *Attorney, Agent, or Firm*—Young & Thompson

(57) ABSTRACT

A record head for applying laser light for drawing to a record medium and a record medium are supported so that they can be relatively moved in a main scanning direction and a sub scanning direction along the surface of the record medium through a move guide mechanism. The record head has a laser displacement sensor for detecting the distance to the light exposure position of the record medium in a noncontact manner. A record apparatus has an auto focus mechanism for correcting misregistration between the focus position of the laser light for drawing emitted from the record head and the record medium to a reference value based on the detection value of the laser displacement sensor, so that the focal distance between the record head and the record medium is held good regardless of deformation of a guide rail of the move guide mechanism, etc.

14 Claims, 8 Drawing Sheets

RECORDING PROCESS CHART

STEP 1: FIX MEMBER TO BE RECORDED TO STAGE

STEP 2: SUPERPOSE IMAGE RECEPTION SHEET ON MEMBER TO BE RECORDED

STEP 3: LAMINATE IMAGE RECEPTION SHEET (SKIPPED OPTIONALLY)

STEP 4: PEEL-OFF SUPPORT LAYER OF IMAGE RECEPTION SHEET
→ IMAGE RECEPTION LAYER IS FORMED ON MEMBER TO BE RECORDED

STEP 5: DEPOSIT K (BLACK) TRANSFER SHEET

STEP 6: LAMINATE K (OPTIONALLY)

STEP 7: RECORD DATA FOR K WITH LASER LIGHT

STEP 8: PEEL-OFF K
→ PART OF IMAGE FORMING LAYER OF K IS TRANSFERRED ONTO IMAGE RECEPTION LAYER

STEP 9: DEPOSIT R (RED) TRANSFER SHEET IN CLOSE ADHESION

STEP 10: LAMINATE R (OPTIONALLY)

STEP 11: RECORD DATA FOR R WITH LASER LIGHT

STEP 12: PEEL-OFF R

STEP 13: DEPOSIT G (GREEN) TRANSFER SHEET IN CLOSE ADHESION

STEP 14: LAMINATE G (OPTIONALLY)

STEP 15: RECORD DATA FOR G WITH LASER LIGHT

STEP 16: PEEL-OFF G

STEP 17: DEPOSIT B (BLUE) TRANSFER SHEET IN CLOSE ADHESION

STEP 18: LAMINATE B (OPTIONALLY)

STEP 19: RECORD DATA FOR B WITH LASER LIGHT

STEP 20: PEEL-OFF B

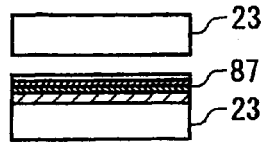

FIG. 4A

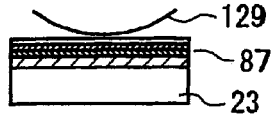

FIG. 4B

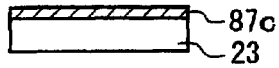

FIG. 4C

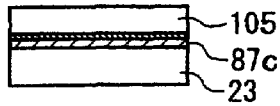

FIG. 4D

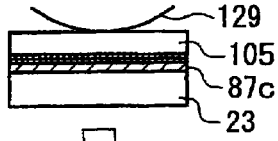

FIG. 4E

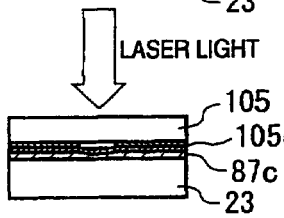

FIG. 4F

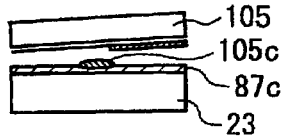

FIG. 4G

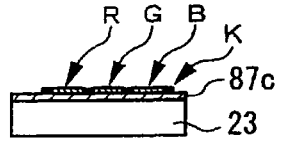

FIG. 4H

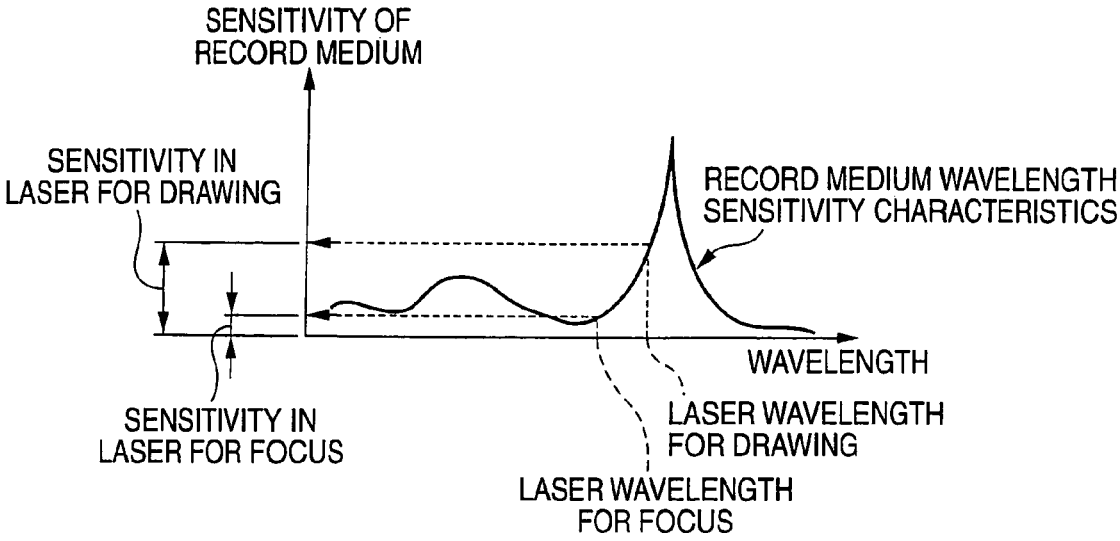
FIG. 6
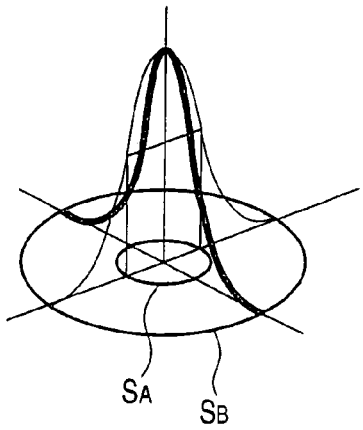

RECORDING METHOD AND RECORDING APPARATUS UTILIZING LASER FOCUSING ELEMENT

BACKGROUND OF THE INVENTION

1. Field of the Invention

This invention relates to a record method and a record apparatus for recording an image onto the surface of a record medium supported as a plane by exposing to laser light for drawing in a main scanning direction and a sub scanning direction.

2. Description of the Related Art

An apparatus having the configuration shown in FIG. 10 is developed as a record apparatus for recording data of text, image, etc.

A record apparatus 21 shown in FIG. 10 records information, such as images, characters, patterns on the surface of a plate-like member to be recorded, such as a glass substrate, a slate, a metal plate and a ceramic plate, through a record medium such as a transfer sheet having a light-to-heat converting layer and an image forming layer.

The record apparatus 21 has, as the basic configuration, a record section 39 provided with a stage 27 that holds a plate-like member to be recorded 23 through suction and being movable along a parallel plane with a record face 25 of the member to be recorded 23 and a record head 29 from which laser light for drawing is emitted, a sheet-like record medium (an image reception sheet or a transfer sheet) on which an image or the like is recorded as being exposed through spot irradiation of laser light for drawing emitted from the record head 29, a record medium supply section 31 for supplying the record medium so as to be deposited on the record face 25 of the member to be recorded 23 held on the stage 27, a pressure roller for pressing and thereby bringing the record medium deposited on the record face 25 of the member to be recorded 23 in transferring a recorded image on the record medium onto the member to be recorded 23, and peel-off means (a peel-off roller, peel-off grooves, peel-off claws) for peeling off the record medium from which the recorded image has been transferred from the member to be recorded 23.

The stage 27 is supported by a move guide mechanism 11 shown in FIG. 11 movably in two orthogonal directions of X direction and Y direction along the surface (plane) of the record medium on the member to be recorded 23.

The move guide mechanism 11 specifically includes a first slide base 12 with a top face 12*a* on which the stage 27 is placed, first guide rails 13 for supporting the first slide base 12 so as to enable the first slide base 12 to move linearly along the top face 12*a*, a second slide base 14 with a top face to which the first guide rails 13 are fixed, and second guide rails 15 for supporting the second slide base 14 so as to enable the second slide base 14 to move linearly in the orthogonal direction to the move direction of the first slide base 12. The guide directions of the guide rails 13 and 15 are the move directions of the stage 27 shown in FIG. 10 (namely, X direction and Y direction).

A moving range of the stage 27 allowed by the moving guide mechanism includes a first quadrant S1, a second quadrant S2, a third quadrant S3, and a fourth quadrant S4 around a recording original point position 69, the area of each area being equal to the area of the stage 27. That is, the stage 27 is allowed to move by a distance twice the size length and width in the X direction and the Y direction. The X direction and the Y direction are respectively the main scanning direction and the sub scanning direction of laser light for drawing, which allows the record head 29 positioned at the recording original point position 69 to scan relatively with respect to the stage 27 at all the positions.

The record head 29 is constituted movably either at a standby position 65 or the record original position 69, so that it is retracted to the standby position 65 when the member to be recorded 23 or the record medium is carried in or out from the stage 27, and returned to the recording original point position 69 when an image is recorded through irradiation of laser light for drawing to the record medium on the member to be recorded 23.

Further, in addition to the basic arrangement described above, the record apparatus 21 includes a member-to-be-recorded supply section 33 in which members to be recorded 23 are stored in piles, a carry-in mechanism 49 for transporting a member 23 to be recorded to the stage 27 from the member-to-be-recorded supply section 33, an discharge mechanism 51 for discharging the member to be recorded 23, on which the image has been transferred, from the stage 27, and a member-to-be-recorded reception portion 35 in which members to be recorded 23 discharged by the discharge mechanism 51 are placed and stored in piles. Numeral 37 in FIG. 10 denotes a trash box into which a used recording medium is discarded.

In addition, in terms of safety, such as prevention of leakage of laser light, the record apparatus 21 is arranged in such a manner that a shielding frame 41 covers the peripheries of the record section 39 and the recording medium supply section 31. The shielding frame 41 is provided with an openable and closable passing opening portion through which a member to be recorded 23 is carried in or discharged, and a passing opening portion through which a used recording medium is discharged.

The described record apparatus 21 records information such as images, characters, and patterns on the record face 25 of the member to be recorded 23 according to the following procedure.

The record head 29 is previously retreated to the standby position 65 and the member to be recorded 23 with the record face 25 up is at first held on the top of the stage 27 through suction. An image reception sheet as a record medium supplied from the record medium supply section 31 is intimately deposited on the record face 25 of the member to be recorded 23 held on the stage 27. After an image reception layer of the image reception sheet is transferred to the record face 25, an unnecessary portion (support layer) of the image reception sheet is peeled off and discarded. Next, a transfer sheet of a record medium supplied from the record medium supply section 31 is intimately deposited on the image reception layer on the record face 25. Then, the record head 29 is returned to the record original position 69.

Next, the laser light for drawing emitted from the record head 29 and move of the stage 27 in the X direction and the Y direction are controlled to expose the laser light for drawing on the surface of the record member (transfer sheet). Information such as images, characters, and patterns is recorded on the transfer sheet.

The information such as images, characters, patterns recorded on the transfer sheet is transferred onto the record face 25 as the transfer sheet is in intimate contact with the light reception layer on the record face 25 of the member to be recorded 23. If the transfer sheet from which the information was transferred is peeled off from the member to be recorded 23, the member to be recorded 23 with the information such images, characters, patterns recorded on the record face 25 is provided.

The member to be recorded 23 with the information recorded is ejected through the discharge mechanism 51 to the member-to-be-recorded reception portion 35.

The described record apparatus 21 can record a hyperfine images and so on by making the stage 27 move with high accuracy by the move guide mechanism 11. The recorded apparatus 21 is useful in a wide range of technical fields requiring micromachining such as formation of a black stripe filter of a display, formation of a circuit pattern in a printed circuit substrate, etc.

By the way, the improvement of the dimension accuracy and the attachment accuracy of the used parts is required for the move guide mechanism 11 to move with high accuracy, so that the focal distance in the optical axis direction of laser light for drawing emitted from the record head 29 becomes within the focal depth.

However, as the second guide rails 15, etc., of the move guide mechanism 11 are elongated, these easily become deformed because of screwing when they are fixed to a surface plate, etc., or thermal expansion or thermal shrinkage caused by change in ambient temperature.

The degree of deformation is proportional to the rigidity of the material used for the second guide rails 15, etc.

For example, when the second guide rails 15, etc., are formed from an aluminum alloy, etc., having good workability, the second guide rails 15, etc., become largely deformed because of screwing when they are attached or thermal expansion, thermal shrinkage, etc., as shown in FIGS. 12B to 12D. Therefore, even if the work accuracy of the parts is enhanced, it becomes difficult to maintain the focal distance in the optical axis direction of laser light for drawing within the focal depth.

As the focal depth changes with deformation of the second guide rails 15, etc., disadvantages such as degradation of the resolution of a record image, occurrence of unevenness of an image, etc., occur at the record operation.

Such deformation can be deceased by changing the material to stainless steel higher in rigidity than an aluminum alloy, etc., or a slate such as marble, etc., having higher rigidity than stainless steel. If a slate such as marble, etc., is used, it becomes comparatively easy to maintain the focal distance in the optical axis direction of laser light for drawing within the focal depth.

However, if a material having high rigidity is selected for the material, the manufacturing cost increases because workability degrades.

For example, assuming that the manufacturing cost per shaft of the slide mechanism is about 1,000,000 yen to form a guide rail of an aluminum alloy, the manufacturing cost per shaft is about 3,000,000 yen to form a guide rail of stainless steel or is about 10,000,000 yen to form a guide rail of a stone material of marble, etc. If the move operation of the move guide mechanism 11 is made highly accurate using a stone material, there is a problem of extremely increasing the manufacturing cost.

SUMMARY OF THE INVENTION

The object of the invention is to provide a record method and a record apparatus for improving the position accuracy in the optical axis direction of laser light for drawing without forming guide rails of a move guide mechanisms with expensive material, thereby accomplishes image record with high resolution and high quality at low cost.

The invention provides a record method of recording an image onto a record medium by exposing to laser light for drawing while relatively moving the record medium supported as a plate and a record head for emitting the laser light for drawing to the surface of the record medium in a main scanning direction and a sub scanning direction along a surface of the record medium through a move guide mechanism, having steps of: detecting a distance to a light exposure position of the record medium in a noncontact manner; and correcting misregistration between the focus position of the laser light for drawing emitted from the record head and the record medium based on a value detected by the detecting step so as to keep exposure conditions of the laser light for drawing from the record head to the record medium at a reference value.

According to the invention, if the relative positional relationship between the record head and the record medium affecting the position accuracy in the optical axis direction of laser light for drawing deviates from the reference value because of deformation of a guide rail used for the move guide means, etc., the misregistration amount is detected by the displacement sensor and the auto focus means having the control section for monitoring output of the displacement sensor corrects the misregistration between the focus position of laser light for drawing emitted from the record head and the record medium to the reference value.

Therefore, the focal distance in the optical axis direction of laser light for drawing can always be stably maintained within the preset focal depth regardless of deformation of the guide rail used for the move guide means, etc.

The record method further has step of: applying laser light for focus to the record medium, wherein the laser light for focus does not leave traces having an effect on drawing by applying the laser light for drawing on the record medium.

The traces having an effect on drawing by applying the laser light for drawing means cause of alteration or deformation to occur on the function layer or the surface layer of the record medium in such a manner that proper reaction is not shown to light exposure under stipulated record conditions of laser light for drawing (power, record speed, record density, etc.).

As in the record method, the laser light for focus output by the laser displacement sensor does not leave traces having an effect on drawing by applying the laser light for drawing. Therefore, full use of the high-accuracy drawing performance of the laser light for drawing can be made for accomplishing image record with high resolution and high quality.

Further, each wavelength of the laser light for drawing and the laser light for focus and wavelength sensitivity characteristics of the record medium are set so that sensitivity of the record medium upon exposure of the laser light for focus is 50% or less of sensitivity of the record medium upon exposure of the laser light for drawing.

A light-to-heat conversion layer and A image formation layer making up the record medium usually have wavelength dependency showing high sensitivity to laser light of a specific wavelength and low sensitivity to laser light of any other wavelength.

Then, the wavelengths of the laser light for focus and the laser light for drawing are set so that the laser light for focus shows half sensitivity of the laser light for drawing relative to the wavelength sensitivity characteristics of the record medium, thereby an environment that exposure of the laser light for focus does not affect drawing by applying the laser light for drawing can be easily ensured.

Further, difference of wavelength between the laser light for focus and the laser light for drawing is 100 nm or more.

Usually the sensitivity is degraded to 50% or less in the wavelength range having a difference of 100 nm or more from the wavelength having the peak value of sensitivity in the wavelength sensitivity characteristics of the record medium.

Therefore, assuming that the laser light for drawing is set in the vicinity of the peak value of the sensitivity of the record medium, as in the above-described record method, the wavelength of the laser light for focus is set to a wavelength having a difference of 100 nm or more from the wavelength of the laser light for drawing, whereby it substantially become possible to suppress the sensitivity of the laser light for focus to 50% or less of the sensitivity of the laser light for drawing, and an environment that exposure of the laser light for focus does not affect drawing by applying the laser light for drawing can be ensured.

Further, the power of the laser light for focus is 50% or less of power of the laser light for drawing.

As in the record method, an environment that exposure of the laser light for focus does not affect drawing by applying the laser light for drawing can also be ensured by regulating the power of the laser light for focus.

Further, power density of the laser light for focus is 50% or less of power density of the laser light for drawing.

As in the record method, an environment that exposure of the laser light for focus does not affect drawing by applying the laser light for drawing can also be ensured by regulating the power density of the laser light for focus.

The power density is inversely proportional to the spot area at the light application time and thus any desired power density can be set by changing the spot area even with laser light of the same power. The regulating method of the laser light for focus according to the power density can be introduced for enlarging the flexibility of laser displacement sensor selection.

Further, the record medium is a binary sensitive material having a density gradation characteristics that one of maximum density and minimum density are selectively provided in response to input energy according to whether the input energy is lager or smaller than a threshold value.

In the record method, as the record medium is a binary sensitive material having a density gradation characteristics that gamma becomes steep relative to the threshold value of input energy, an image can be recorded upon exposure of laser light for drawing set to input energy larger than the threshold value, but an image cannot be recorded upon exposure of laser light for focus set to input energy smaller than the threshold value.

Further, the laser displacement sensor is provided with the record head so that exposure position of the laser light for focus is on the side of downstream in a main scanning direction and downstream in a sub scanning direction relative to exposure position of the laser light for drawing.

In the record method, the laser light for focus application position becomes an image-unrecorded area wherein drawing by applying laser light for drawing is not yet completed.

In an area where an image is already recorded (drawing by applying laser light for drawing is completed), it occurs alteration such as the support of the record medium becomes deformed because of heat generation at the light exposure time of laser light or the substance such as the light-to-heat conversion layer is decomposed due to heat. If laser light for focus is applied to the deformed part of the record medium as the part is exposed to laser light for drawing, the distance to the record medium cannot precisely be calculated because the reflection angle from the record medium changes from the normal reflection angle. If laser light for focus is applied to the decomposed substance part of the record medium as the part is exposed to laser light for drawing, the distance to the record medium cannot precisely be calculated because the reflection factor from the record medium changes from the normal reflection factor.

However, if the laser light for focus application position is set in an image unrecorded area where drawing by applying laser light for drawing is not yet completed as in the record method, it become possible for the laser displacement sensor to precisely calculate the distance to the record medium because it does not occurs disturbance caused by deformation of the record medium, decomposition of the formation substance, etc.

Further, the laser displacement sensor is provided with the record head so that a center position of a spot on the record medium by applying the laser light for focus is distant 0.5 mm to 20 mm from a boundary of an image recorded area where the laser light for drawing is applied to a side of an image unrecorded area where the laser light for drawing is not applied.

If the spot center of laser light for focus is too close to the area of the record medium where an image is already recorded, it is feared that the above-mentioned alteration of the record medium at the image record time or the like may affect reflection of laser light for focus. If it is too far from the laser light for drawing application position, it is feared that an error between position information in the optical axis direction of laser light for drawing and position information in the optical axis direction of laser light for focus will become large, resulting in degradation of the reliability of the detection accuracy of the laser displacement sensor.

However, the distant position from the image recorded area is set specifically as in the record method, thereby preventing degradation of the reliability of the laser displacement sensor caused by the fact that the laser light for focus application position is too close to or too far from the area where an image is already recorded.

The invention provides a record apparatus for recording an image onto a record medium by exposing to laser light for drawing while relatively moving the record medium supported as a plate and a record head for emitting the laser light for drawing to the surface of the record medium in a main scanning direction and a sub scanning direction along a surface of the record medium through a move guide mechanism, having: a laser displacement sensor for applying laser light for focus to the record medium to detect a distance to a light exposure position of the record medium in a non-contact manner, which is placed in the record head; and an auto focus means including a control section for monitoring output of the laser displacement sensor, and for correcting misregistration between a focus position of the laser light for drawing emitted from the record head and the record medium based on a detection value of the laser displacement sensor so as to keep exposure conditions of the laser light for drawing from the record head to the record medium at a reference value.

Further, a binary sensitive material having density gradation characteristics that maximum density and minimum density are selectively provided in response to input energy according to whether the input energy is lager or smaller than a threshold value.

Further, the laser displacement sensor is provided with the record head so that exposure position of the laser light for focus is on the side of downstream in a main scanning direction and downstream in a sub scanning direction relative to exposure position of the laser light for drawing.

Further, the laser displacement sensor is provided with the record head so that a center position of a spot on the record medium by applying the laser light for focus is distant 0.5 mm to 20 mm from a boundary of an image recorded area where the laser light for drawing is applied to a side of an image unrecorded area where the laser light for drawing is not applied.

Further, each wavelength of the laser light for drawing and the laser light for focus and wavelength sensitivity characteristics of the record medium are set so that sensitivity of the record medium upon exposure of the laser light for focus is 50% or less of sensitivity of the record medium upon exposure of the laser light for drawing.

Further, difference of wavelength between the laser light for focus and the laser light for drawing is 100 nm or more.

Further, power of the laser light for focus is 50% or less of power of the laser light for drawing.

Further, power density of the laser light for focus is 50% or less of power density of the laser light for drawing.

BRIEF DESCRIPTION OF THE DRAWINGS

FIG. 4 is a schematic representation to conceptually represent a record process on the record medium 5 shown in FIG. 3;

FIG. 5 is a graph to show the wavelength difference between laser light for drawing and laser light for focus used with a record method and the record apparatus of the invention;

FIG. 6 is a schematic representation to show the power density difference between laser light for drawing and laser light for focus used with the record method and the record apparatus of the invention;

DETAILED DESCRIPTION OF THE PREFERRED EMBODIMENTS

Referring now to the accompanying drawings, there are shown preferred embodiments of a record method and a record apparatus according to the invention.

Figure 1:
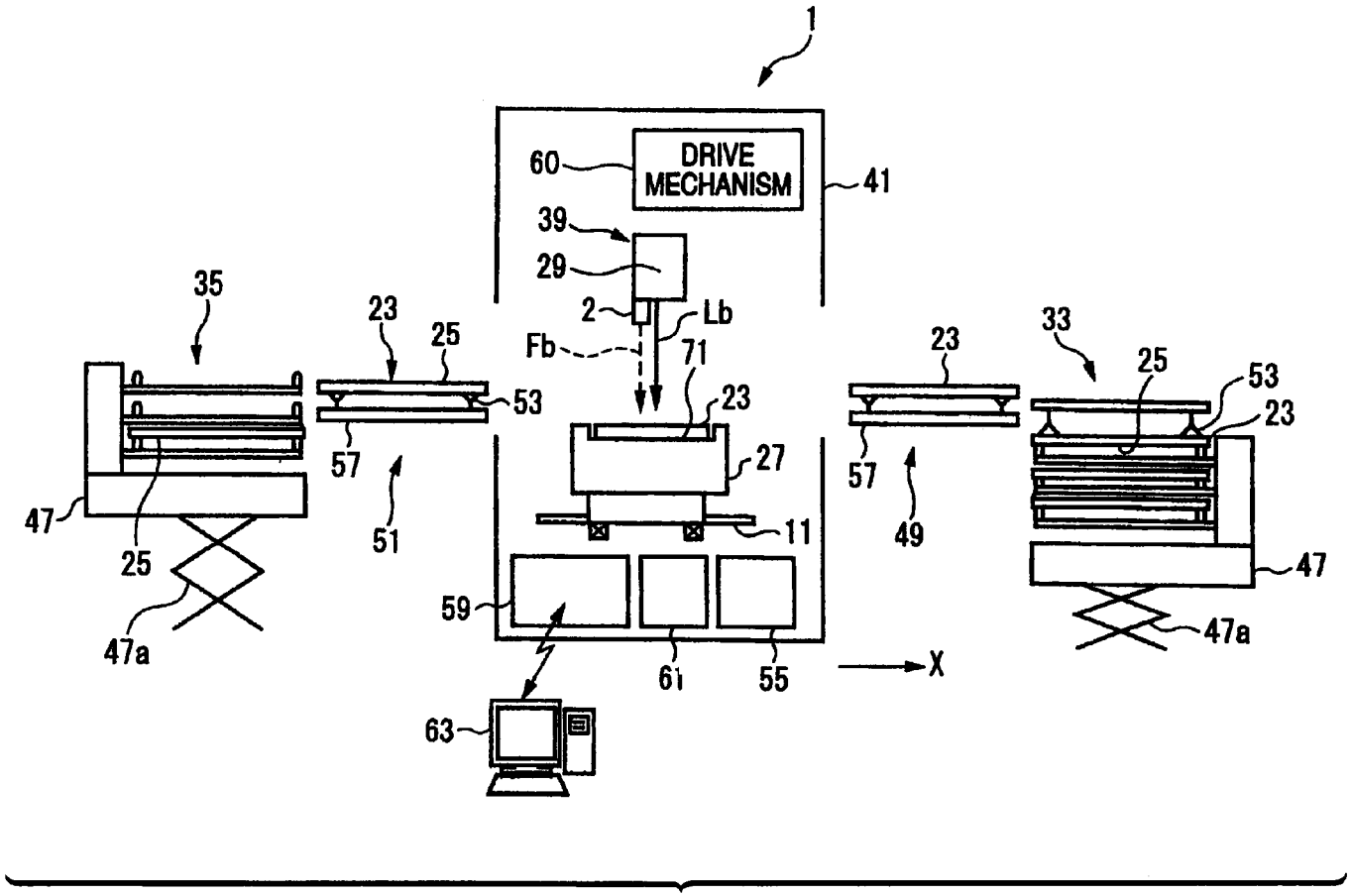
FIG. 1 is a block diagram to show a schematic configuration of a record apparatus according to the invention.
Figure 2:
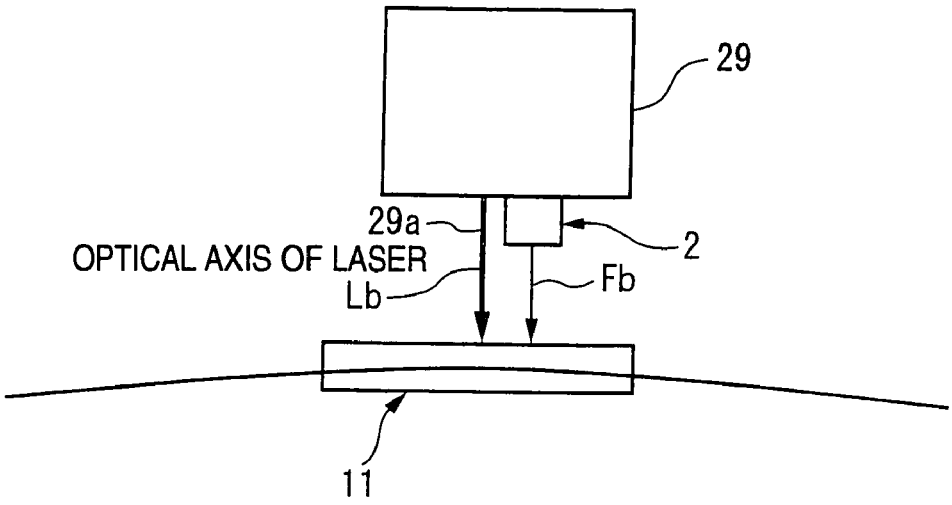
FIG. 2 is an enlarged drawing to show the relationship between a record head and a move guide mechanism in FIG. 1.

FIG. 1 is a block diagram to show a schematic configuration of a record apparatus according to the invention. FIG. 2 is an enlarged drawing to show the relationship between a record head and a move guide mechanism in FIG. 1.

A record apparatus 1 according to the embodiment is an improvement of the record apparatus 21 previously described with reference to FIG. 10. Concretely, the record apparatus 1 further has the a laser displacement sensor 2 as a displacement sensor attached to a record head 29 to implement an auto focus mechanism for correcting the positional relationship between the record head 29 and a stage 27 along the optical axis direction of laser light for drawing emitted by the record head 29 to a reference value based on output of the laser displacement sensor 2. Other components of the record apparatus 1 are similar to or same as those of the record apparatus 21 shown in FIG. 10. Therefore, those components are denoted by the same reference numerals.

That is, the record apparatus 1 has, as the basic configuration, a record section 39 provided with the stage 27 that holds a plate-like member to be recorded 23 and through suction and being movable along a parallel plane with a record face 25 of the member to be recorded 23 and the record head 29 from which laser light for drawing is emitted, a sheet-like record medium 5 (see FIG. 3) on which an image or the like is recorded as being exposed through spot irradiation of laser light for drawing emitted from the record head 29, a record medium supply section 31 for supplying the record medium 5 so as to be deposited on the record face 25 of the member to be recorded 23 held on the stage 27, a pressure roller for pressing and thereby bringing the record medium 5 deposited on the record face 25 of the member to be recorded 23 in transferring a recorded image on the record medium 5 onto the member to be recorded 23, and peel-off means (a peel-off roller, peel-off grooves, peel-off claws) for peeling off the record medium 5 from which the recorded image has been transferred from the member to be recorded 23.

Figure 11:
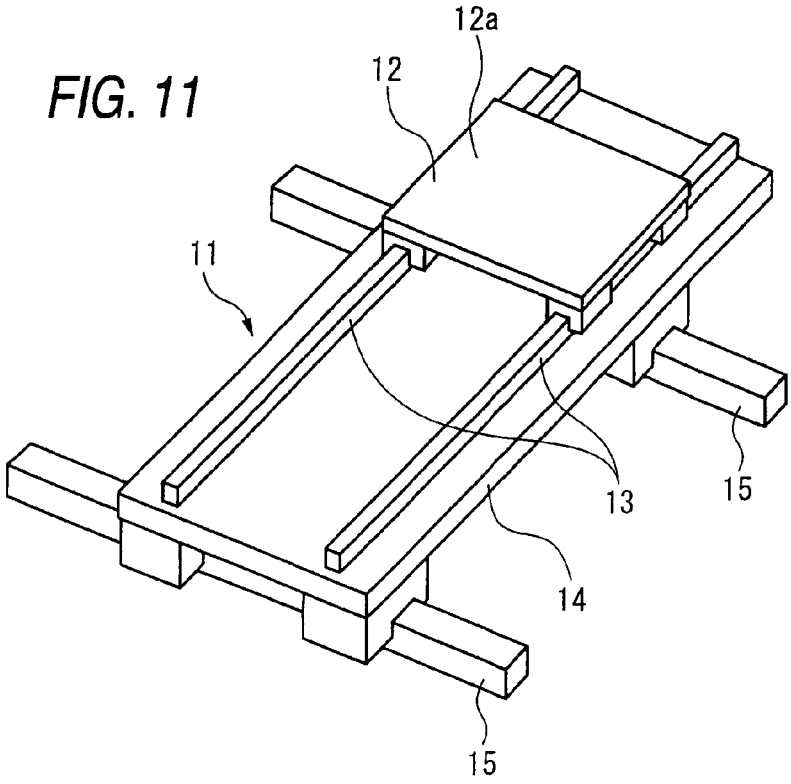
FIG. 11 is an enlarged perspective view of a move guide mechanism for producing relative replacement between a record head and a record medium in the record apparatus in the related art.
Figure 12A:
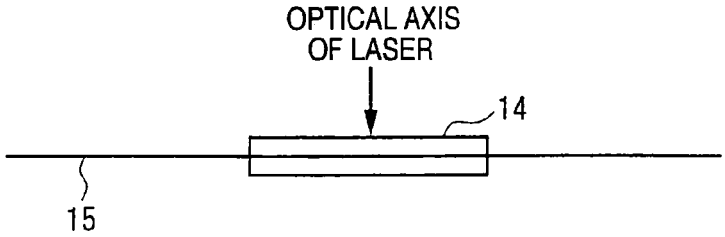
FIGS. 12A to 12D are schematic representations of disadvantages occurring when guide rails are formed of inexpensive material in the move guide mechanism shown in FIG. 11.
Figure 12B:
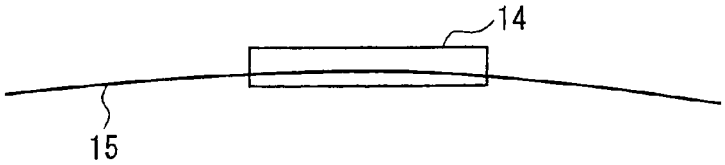
Figure 12C:
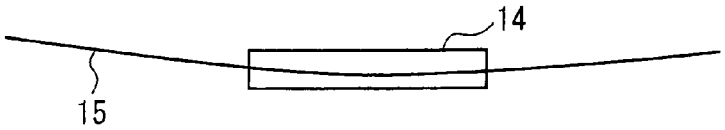
Figure 12D:
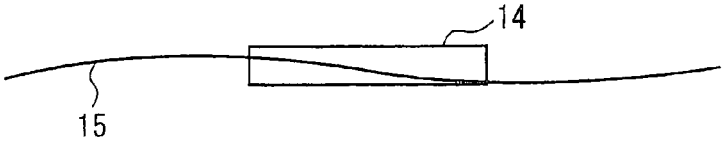

The stage 27 is supported by a move guide mechanism 11 shown in FIG. 11 movably in two orthogonal directions of X direction and Y direction along the surface (plane) of the record medium on the member to be recorded 23.

Figure 10:
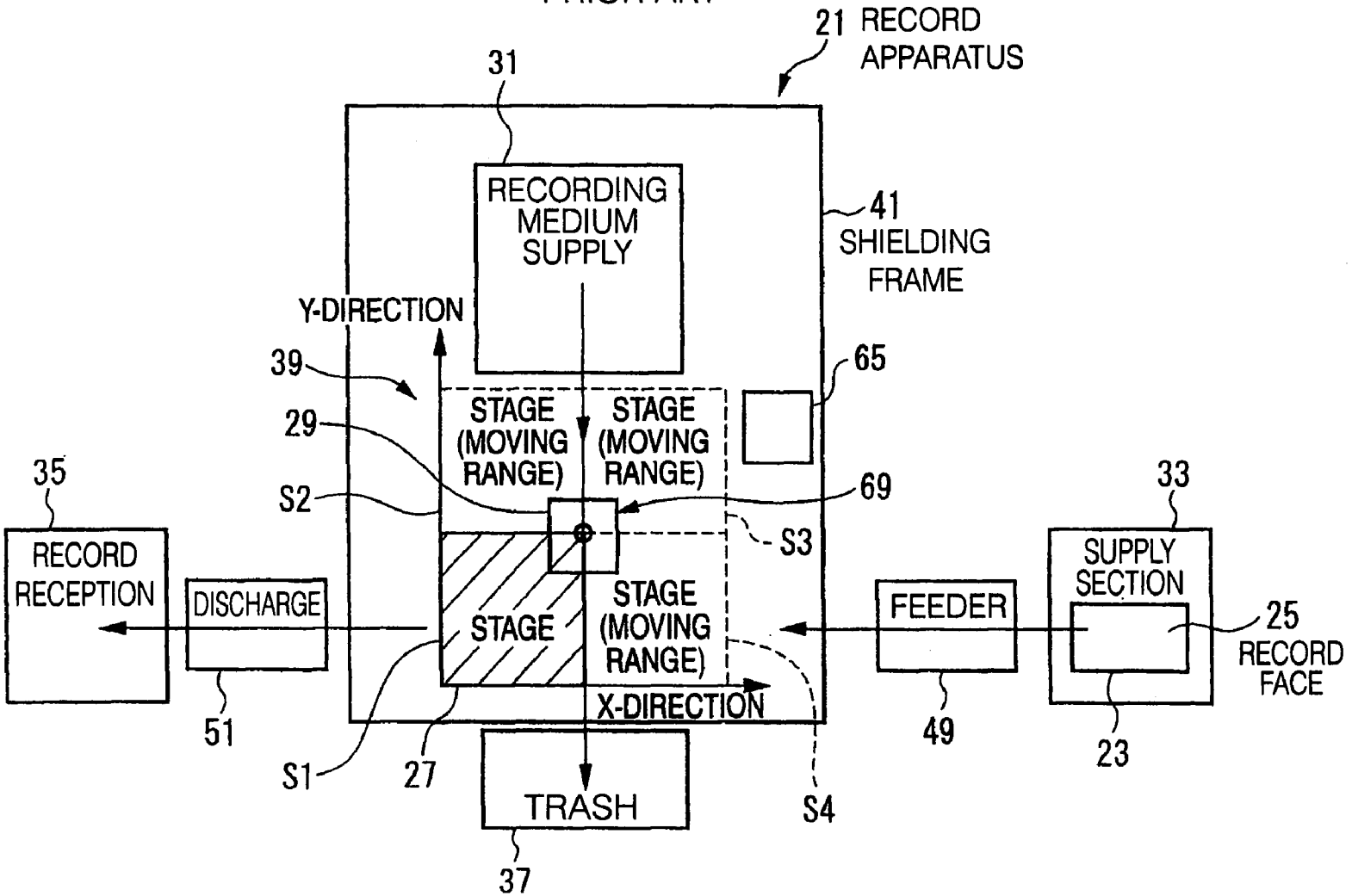
FIG. 10 PRIOR ART
FIG. 10 is a block diagram to show a schematic configuration of a record apparatus in a related art.

The moving range of the stage 27 allowed by the moving guide mechanism includes a first quadrant S1, a second quadrant S2, a third quadrant S3, and a fourth quadrant S4 around a recording original point position 69 shown in FIG. 10, the area of each area being equal to the area of the stage 27. That is, the stage 27 is allowed to move by a distance twice the size length and width in the X direction and the Y direction are respectively the main scanning direction and the sub scanning direction of laser light for drawing, which allows the record head 29 positioned at the recording original point position 69 to scan respectively with respectively to the stage 27 at all the positions.

The record head 29 is constituted movably either at a standby position 65 or the record original position 69 shown in FIG. 10, so that it is retracted to the standby position 65 when the member to be recorded 23 or the record medium is carried in or out from the stage 27, and returned to the recording original point position 69 when an image is recorded through irradiation of laser light for drawing to the record medium on the member to be recorded 23.

Further, in addition to the basic arrangement described above, the record apparatus 1 includes a member-to-be-recorded supply section 33 in which members to be recorded 23 are stored in piles, a carry-in mechanism 49 for transporting a member 23 to be recorded to the stage 27 from the member-to-be-recorded supply section 33, a discharge mechanism 51 for discharging the member to be recorded 23, on which the image has been transferred, from the stage 27, and a member-to-be-recorded reception portion 35 in which members to be recorded 23 discharged by the discharge mechanism 51 are placed and stored in piles.

Each of the record member supply section 33 and the record member reception section 35 has a pedestal 47 on which the record members 23 can be placed at multiple stages. The pedestal 47 has a hoisting and lowering mechanism 47*a* so that the top member to be recorded 23 becomes any desired height. Height control method of the hoisting and lowering mechanism 47*a* includes a method of detecting the weight of the member to be recorded 23 and managing the height constant in response to the decrease number of members to be recorded 23, a method of detecting the position of the top member to be recorded 23 and managing the height constant, a method of storing the thickness of the record members 23 and managing the height while subtracting the number of used record members, or the like.

Each of the carry-in mechanism 49 and the discharge mechanism 51 has suction cups 53 attached to a base 57. The base 57 can reciprocate between the stage 27 and the carry-in mechanism 49 or the discharge mechanism 51 by means of a slide rail or a guide groove (not shown). Any drive source such as an electric motor, an air cylinder, a hydraulic cylinder, or the like drives the base 57. The carry-in mechanism 49 and the discharge mechanism 51 may be a linear motor or a robot arm having the above-described configuration in one piece.

The suction cups 53 placed on the base 57 holds the member to be recorded 23 in a vacuum suction manner when the member to be recorded 23 is carried in and out.

The outer peripheries of the record section 39 and the record medium supply section 31 in the record apparatus 1 are covered with a shield frame 41 from the viewpoint of safety such as laser leakage prevention. The shield frame 41 is formed with an openable and closable passing opening section through which a member to be recorded 23 is carried in or discharged, and a passing opening section through which a used recording medium is discharged.

A controller 59, a suction source 55, a power supply 61, and the like are placed in the shield frame 41 of the record apparatus 1.

The controller 59 is a controller for controlling the operation of each components such as an image formation circuit of the record head 29, a drive motor for moving the record head 29 between the standby position 65 and the record origin position 69 shown in FIG. 10, a drive motor for moving the stage 27 lengthwise and crosswise by the move guide mechanism 11, the carry-in mechanism 49, the discharge mechanism 51, the suction source 55, the laser displacement sensor 2, and the auto focus mechanism for correcting the positional relationship between the record head 29 and the stage 27 along the optical axis direction of laser light for drawing emitted by the record head 29 to the reference value based on output of the laser displacement sensor 2.

The controller 59 is connected to a host computer 63 outside the apparatus by a communication line, so that image formation control and control of supply and ejection of the record members 23, etc., can be performed from the host computer 63 by transmitting and receiving control signal.

The suction source 55 supplies a negative pressure suction force to the parts where suction of the member to be recorded 23 is necessary, such as the stage 27 and the suction cups 53 of the carry-in mechanism 49 and the discharge mechanism 51.

The power supply 61 supplies power to the controller 59, the suction source 55, the driving motors, etc.

In the embodiment, the laser displacement sensor 2 attached to the record head 29 applies laser light Fb for focus to the record medium 5 on the stage 27 to detect the distance to the light exposure position of the record medium 5 in a noncontact manner, and sends output responsive to the detection value to the controller 59.

The auto focus mechanism corrects misregistration between the focus position of laser light for drawing emitted from the record head 29 and the record medium 5. The auto focus mechanism is constituted of a drive mechanism 60 for enabling to adjust the distance between the record head 29 and the stage 27 in the optical axis direction of laser light for drawing and a control section for controlling the operation of the drive mechanism 60.

The controller 59 also serves as the control section of the auto focus mechanism. The control section monitors output of the laser displacement sensor 2, controls the operation of the drive mechanism 60 based on the detection value of the laser displacement sensor 2 at the scanning time of laser light for drawing so as to keep the exposure conditions (the distance between the record head 29 and the stage 27) of the laser light for drawing from the record head 29 to the record medium 5 at a reference value, and corrects misregistration between the focus position of laser light for drawing emitted from the record head 29 and the record medium 5 to the preset reference values.

The laser light for focus emitted from the laser displacement sensor 2 is set to the specifications such that traces having an effect on drawing under stipulated record conditions of laser light for drawing (power, record speed, record density, etc.,) are not left on the record medium. Specifically, in the embodiment, each wavelength of the laser light for drawing and the laser light for focus and the wavelength sensitivity characteristics of the record medium are set so that the sensitivity of the record medium 5 upon exposure of the laser light for focus becomes 50% or less of the sensitivity of the record medium 5 upon exposure of the laser light for drawing.

Next, the record medium 5 used to transfer an image to the record face 25 of the member to be recorded 23 and the image record process on the record medium 5 will be discussed.

Figure 3:
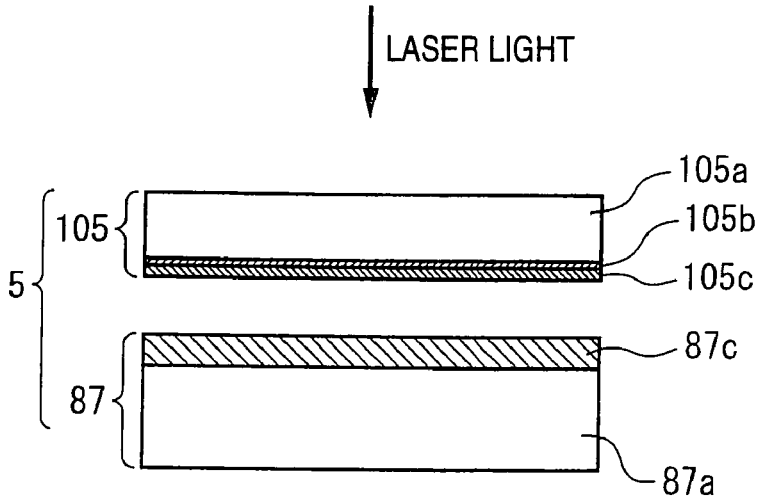
FIG. 3 is a sectional view of a record medium 5 made up of an image reception sheet and a transfer sheet used with the record apparatus in FIG. 1.

As shown in FIG. 3, the record medium 5 is composed of an image reception sheet 87 and a transfer sheet 105 deposited on the image reception sheet 87.

The image reception sheet 87 is composed of a support layer 87*a* and an image reception layer 87*c*, which are generally deposited vertically in this order, as shown in FIG. 3. A PET (polyethylene terephthalate) base, a TAC (triacetylcellulose) base, a PEN (polyethylene naphthalate) base, etc., can be used for the support layer 87*a*. The image reception layer 87*c* has a function of receiving toner being transferred.

As shown in FIG. 3, the transfer sheet 105 is composed of a support layer 105*a*, a light-to-heat conversion layer 105*b*, and an image formation layer (toner layer) 105*c*, which are deposited vertically in this order. The support layer 105*a* can be arbitrarily selected from typical support body materials (for example, support materials same as those specified above as the material for the support layer 87*a* of the image reception sheet 87) as long as it is a material capable of transmitting a laser light. The light-to-heat conversion layer

105*b* has a function of converting laser energy to heat. The light-to-heat conversion layer 105*b* can be arbitrarily selected from typical light-to-heat conversion materials, including carbon, a black material, an infrared absorption dye, a specific wavelength absorption material, etc. as long as it is material capable of converting light energy to heat energy. The color of the toner layer 105*c* can be, for example, black (B), read (R), green (G), and blue (B) as well as cyan (C), magenta (M), and yellow (Y) for printing, or alternatively gold, silver, orange, gray, pink, etc., called special colors The record apparatus 1 described above normally records an image pattern on the record surface 25 of the member 23 subject to recording according to the procedure detailed in FIG. 4.

Initially, the record head 29 is retreated to the standby position, 65 and step 1 is performed.

In step 1, the member-to-be-recorded supply section 33 supplies the record section 39 with a member to be recorded 23 through the carry-in mechanism 49 so as to be fixed to the concave portion of the stage 27 through suction.

Then, in step 2, the image reception sheet 87 is supplied from the record medium supply section 31 and superposed on the member to be recorded 23 on the stage 27, so that the image reception sheet 87 is deposited thereon.

The image reception sheet 87 is brought into close adhesion to the member to be recorded 23 by a squeeze roller 129.

After this, the image reception sheet 87 may be subjected to heat contact-bonding (that is, laminated) through the use of a heat roller in step 3.

Then, in step 4, the image reception sheet 87 is peeled off from the member to be recorded 23, and the image reception layer 87*c* of the image reception sheet 87 is thereby transferred onto the member to be recorded 23. The support layer 87*a* of the image reception sheet 87 from which the image reception layer 87*c* has been transferred is carried out from the record section 39 by a suction cup row, and discarded into a trash box 37 shown in FIG. 10.

Then, in step 5, the transfer sheet supply section 83 of the record medium supply section 31 supplies the transfer sheet 105 on the stage 27. The transfer sheet 105 cut into a predetermined length is brought into close adhesion to the member to be recorded 23 by the squeeze roller 129. As with the image reception sheet 87, the transfer sheet 105 may be then subjected to heat contact-bonding (that is, laminated) through the use of the heat roller in step 6.

Then, the record head 29 is returned to the record original point position 69. In step 7, a laser light for drawing Lb is emitted from the record head 29 onto the transfer sheet 105 based on image data provided in advance. Hence, predetermined spots out of plural spots by the laser light for drawing Lb are controlled on/off while the stage 27 is moved in sync with the control.

In other words, predetermined spots scan the rear of the transfer sheet 105 imagewisely.

The given image data is color-separated into images for the respective colors, and laser light exposure is performed based on image data for the respective color-separated colors. The toner layer 105*c* of the transfer sheet 105 is thereby transferred onto the image reception layer 87*c* of the member to be recorded 23, and for example, an image in black (K) is formed on the member to be recorded 23.

Likewise, as shown in steps 9 to 20, image formation is performed for the transfer sheet 105 of the respective colors. A full-color image can be thus obtained.

In the record apparatus 1 described above, if the relative positional relationship between the record head 29 and the transfer sheet 105 affecting the position accuracy in the optical axis direction of laser light for drawing deviates from the reference value because of deformation of a guide rail used with the move guide mechanism 11, etc. when image record operation is performed by applying laser light for drawing from the record head 29, the laser displacement sensor 2 detects the misregistration amount and the auto focus mechanism having the control section for monitoring output of the laser displacement sensor 2 corrects the misregistration between the focus position of laser light for drawing emitted from the record head 29 and the transfer sheet 105 as the record medium to the preset reference value.

Therefore, the focal distance in the optical axis direction of laser light for drawing can always be stably maintained within the preset focal depth regardless of deformation of the guide rail used with the move guide mechanism 11, etc.

Consequently, if the guide rails of the move guide mechanism 11 are formed of material such as an inexpensive aluminum alloy having good workability although deformation somewhat easily occurs rather than expensive stone material, etc., whose deformation scarcely occurs, the position accuracy in the optical axis direction of laser light for drawing can be improved. Image record with high resolution and high quality can thereby be accomplished at low cost.

The light-to-heat conversion layer and the image formation layer making up the record medium usually have wavelength dependency of which sensitivity is high on laser light of a specific wavelength and is low on laser light of any other wavelength, as shown in FIG. 5.

Then, as in the embodiment, wavelengths of the laser light for focus and the laser light for drawing are set so that the laser light for focus shows half sensitivity of the laser light for drawing relative to the wavelength sensitivity characteristics of the record medium, whereby an environment that application of the laser light for focus does not affect drawing by applying the laser light for drawing can be easily ensured.

Therefore, the laser light for focus does not leave traces having an effect on drawing by applying the laser light for drawing on the record medium and full use of the high-accuracy drawing performance of the laser light for drawing can be made for accomplishing image record with high resolution and high quality.

As obvious from FIG. 5, the sensitivity is usually degraded to 50% or less in the wavelength range having a difference of 100 nm or more from the wavelength having the peak value of sensitivity in the wavelength sensitivity characteristics of the record medium.

Therefore, assuming that the laser light for drawing is set in the vicinity of the peak value of the sensitivity of the record medium, as in the above-described record method, the wavelength of the laser light for focus is set to a wavelength having a difference of 100 nm or more from the wavelength of the laser light for drawing, whereby it substantially become possible to suppress the sensitivity of the laser light for focus to 50% or less of the sensitivity of the laser light for drawing, and an environment that application of the laser light for focus does not affect drawing by applying the laser light for drawing can be ensured.

For ensuring an environment that application of the laser light for focus does not affect drawing by applying the laser light for drawing, the power of the laser light for focus may be set to 50% or less of that of the laser light for drawing.

The power density of the laser light for focus may be set to 50% or less of that of the laser light for drawing.

As shown in FIG. 6, since the power density is inversely proportional to the spot area at the light application time, any desired power density can be set by changing spot area such as the spot area of the laser light for drawing is SA of a small diameter and the spot area of the laser light for focus is SB of a large diameter, even if the power of the laser light for drawing and that of the laser light for focus are the same. The regulating method of the laser light for focus according to the power density can be introduced for enlarging the flexibility of laser displacement sensor selection.

Figure 7A:
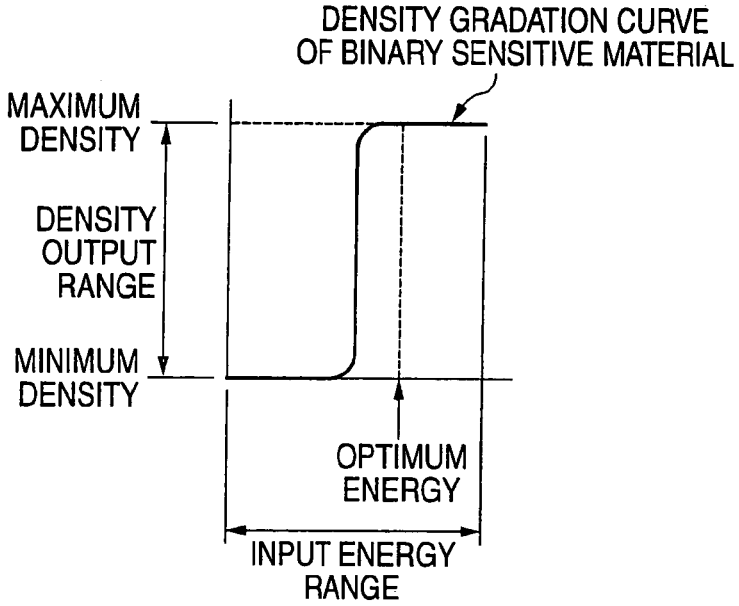
FIG. 7A is a drawing to show a density gradation curve of a binary sensitive material and FIG. 7B is a drawing to show a density gradation curve of a density gradation sensitive material as record media used with the record method and the record apparatus of the invention.
Figure 7B:
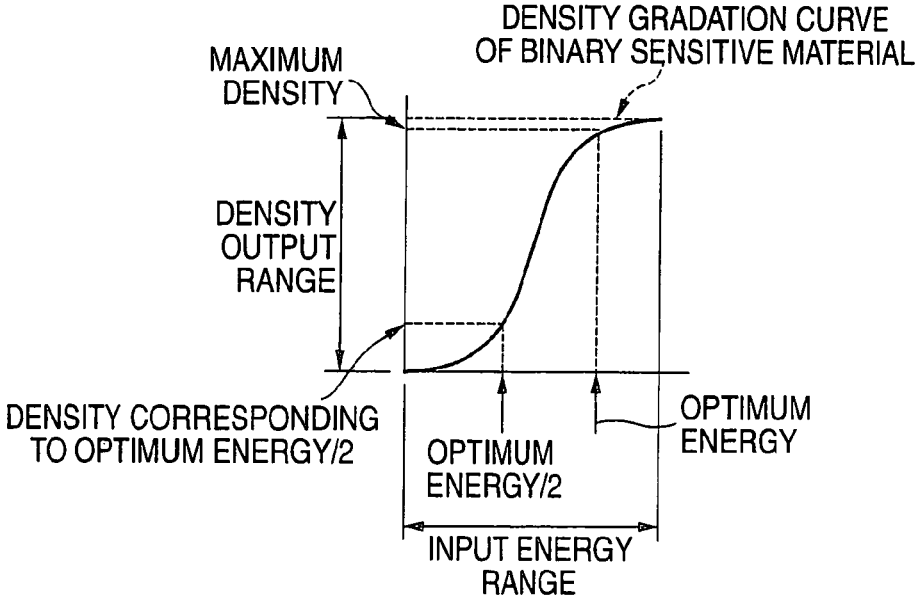

The record medium has density gradation characteristics as shown in FIG. 7. Any desired density is provided by applying laser light and giving predetermined input energy. The record medium shown in FIG. 7A is called binary sensitive material having a density gradation characteristics that the maximum density or the minimum density are selectively provided in response to input energy according to whether the input energy is lager or smaller that a threshold value. The record medium is preferred in the embodiment described above. The record medium shown in FIG. 7B is called density gradation sensitive material having usual density gradation characteristics.

In the binary sensitive material, input energy slightly larger than a value for sufficiently providing the maximum density is usually set as the optimum input energy. Accordingly, even if input energy fluctuation or sensitivity change (threshold value change) of the record medium caused by environmental change occurs, a constant density is provided. In contrast, if input energy slightly falling below the threshold value is given to the record medium, a density is not produced.

Therefore, the density difference between the maximum density and the minimum density can be produced due to a slight record condition (power, power density, etc.,) difference with the threshold value as the boundary, when applying light to the record medium by input energy from laser light for drawing and laser light for focus. Thus, the flexibility of each input energy setup value can be enlarged and the value can be easily set so that laser light for focus does not leave traces having an effect on drawing on the record medium, for example.

On the other hand, the density gradation sensitive material has characteristics that density gradually changes relative to input energy and input energy for providing a predetermined density is usually set as the optimum input energy. Accordingly, when input energy fluctuation or sensitivity change (threshold value change) of the record medium caused by environmental change occurs, the density easily changes.

Therefore, to use such a density gradation sensitive material as the record medium, for example, the input energy from laser light for focus needs to be set to one-tenth of the optimum energy or less. Thus, the selection range of applicable laser is narrowed as compared with the binary sensitive material.

Figure 8:
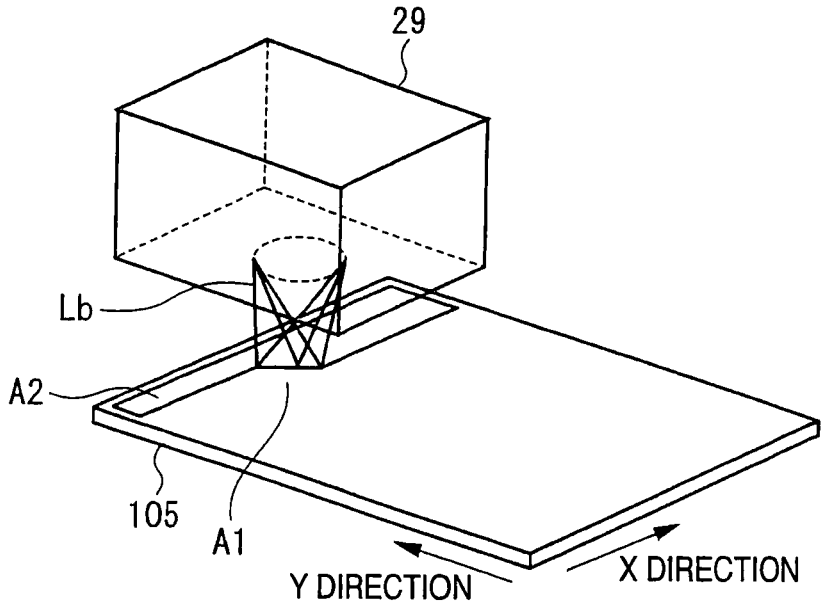
FIG. 8 is a perspective view to show the drawing state of laser light for drawing of the record head in the record method and the record apparatus according to the invention.
Figure 9:
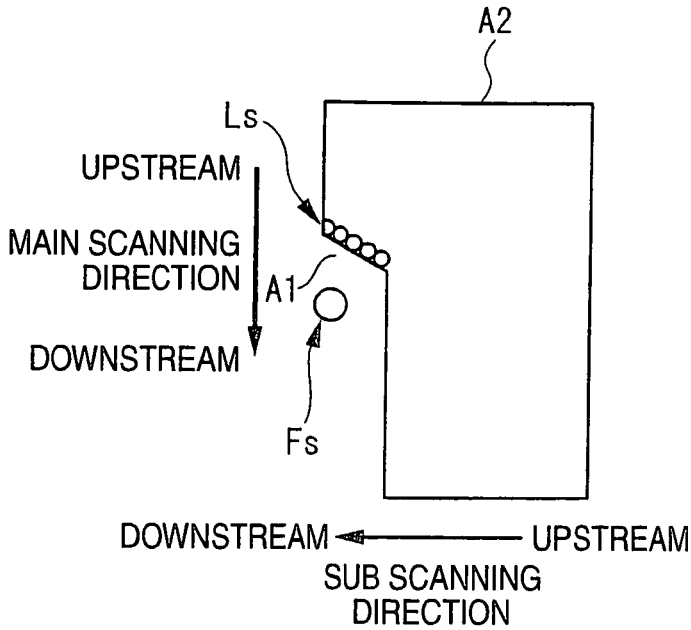
FIG. 9 is a schematic representation to show the placement position of a laser displacement sensor in the record method and the record apparatus according to the invention.

As shown in FIGS. 8 and 9, exposure position (spot position) Fs of the laser light for focus is preferably on the side of downstream in the main scanning direction and downstream in the sub scanning direction relative to exposure position (spot arrangement position) Ls of the laser light for drawing.

By setting the above, the exposure position Fs of the laser light for focus is positioned at an image-unrecorded area A1 where drawing by applying the laser light for drawing does not yet complete.

In an image recorded area A2 where drawing by applying the laser light for drawing completed, alteration occurs, for example, the support layer of the record medium becomes deformed because of heat generation at the light exposure time of laser light or the substance of the light-to-heat conversion layer is decomposed due to heat. If laser light for focus is applied to the deformed part of the record medium where laser light for drawing is exposed, the distance to the record medium cannot precisely be calculated because the reflection angle from the record medium changes from the normal reflection angle.

If laser light for focus is applied to the decomposed substance part of the record medium where laser light for drawing is exposed to, the distance to the record medium cannot precisely be calculated because the reflection coefficient from the record medium changes from the normal reflection factor.

However, if the exposure position of the laser light for focus is set in an image-unrecorded area where drawing by applying laser light for drawing does not yet complete as the record method according to the embodiment, disturbance caused by deformation of the record medium or decomposition of the formation substance, etc., does not occur. Therefore, it becomes possible for the laser displacement sensor to precisely calculate the distance to the record medium.

Further preferably, as shown in FIG. 9, the center position of the spot Fs on the record medium by applying laser light for focus may be set at a position where is distant 0.5 to 20 mm from the boundary of the image recorded area A2 where an image is already recorded by applying the laser light for drawing to the image unrecorded area side where an image is not recorded by applying the laser light for drawing.

If the spot center of laser light for focus is too close to the image recorded area of the record medium, it is feared that the above-mentioned alteration of the record medium at the image record time or the like may affect reflection of laser light for focus. If the spot center of laser light for focus is too far from the exposure position of the laser light for drawing, it is feared that an error between position information in the optical axis direction of laser light for drawing and position information in the optical axis direction of laser light for focus will become large, resulting in degradation of the reliability of the detection accuracy of the laser displacement sensor.

However, the distant position from the image recorded area is set specifically as described above, thereby it become possible to prevent degradation of the reliability of the laser displacement sensor caused by the fact that the laser light for focus application position is too close to or too far from the image recorded area.

The embodiment has been described by taking as an example the case where the stage is moved in the main scanning direction and the sub scanning direction with the record head fixed to the record origin position. However, similar advantages to those described above are provided if the record head is moved in the main scanning direction and the sub scanning direction with the stage fixed. The spot arrangement is not limited to a one-dimensional array and any spot arrangement may be adopted.

In the embodiment, the laser displacement sensor is used as the displacement sensor, but an infrared sensor, an ultrasonic displacement sensor, etc., can also be used.

What is claimed is:

1. A record method of recording an image onto a record medium by exposing to laser light for drawing while relatively moving the record medium supported on a plate and a record head for emitting the laser light for drawing to a surface of the record medium in a main scanning direction and a sub scanning direction along a surface of the record medium through a move guide mechanism, comprising steps of:

applying laser light for focus to the record medium in a noncontact manner, wherein the laser light for focus does not leave traces having an effect on drawing by applying the laser light for drawing on the record medium; and correcting misregistration between a focus position of the laser light for drawing emitted from the record head and the record medium based on a value detected by the detecting step so as to keep exposure conditions of the laser light for drawing from the record head to the record medium at a reference value;

wherein the record medium is a binary sensitive material having a density gradation characteristic that one of maximum density and minimum density are selectively provided in response to input energy according to whether the input energy is larger or smaller than a threshold value.

2. The record method according to claim 1, wherein each wavelength of the laser light for drawing and the laser light for focus and wavelength sensitivity characteristics of the record medium are set so that sensitivity of the record medium upon exposure of the laser light for focus is 50% or less of sensitivity of the record medium upon exposure of the laser light for drawing.

3. The record method according to claim 1, wherein difference of wavelength between the laser light for focus and the laser light for drawing is 100 nm or more.

4. The record method according to claim 1, wherein power of the laser light for focus is 50% or less of power of the laser light for drawing.

5. The record method according to claim 1, wherein power density of the laser light for focus is 50% or less of power density of the laser light for drawing.

6. The record method according to claim 1, wherein a laser displacement sensor is provided with the record head so that exposure position of the laser light for focus is on the side of downstream in a main scanning direction and downstream in a sub scanning direction relative to exposure position of the laser light for drawing.

7. The record method according to claim 6, wherein the laser displacement sensor is provided with the record head so that a center position of a spot on the record medium by applying the laser light for focus is distant 0.5 m to 20 mm from a boundary of an image recorded area where the laser light for drawing is applied to a side of an image unrecorded area where the laser light fordrawing is not applied.

8. A record apparatus for recording an image onto a record medium by exposing to laser light for drawing while relatively moving the record medium supported on a plate and a record head for emitting the laser light for drawing to a surface of the record medium in a main scanning direction and a sub scanning direction along a surface of the record medium through a move guide mechanism, comprising:

a laser displacement sensor for applying laser light for focus to the record medium to detect a distance to a light exposure position of the record medium in a noncontact manner, which is placed in the record head; and an auto focus means including a control section for monitoring output of the laser displacement sensor, and for correcting misregistration between a focus position of the laser light for drawing emitted from the record head and the record medium based on a detection value of the laser displacement sensor so as to keep exposure conditions of the laser light for drawing from the record head to the record medium at a reference value;

wherein the record medium is a binary sensitive material having a density gradation characteristics that maximum density and minimum density are selectively provided in response to input energy according to whether the input energy is larger or smaller than a threshold value.

9. The record apparatus according to claim 8, wherein the laser displacement sensor is provided with the record head so that exposure position of the laser light for focus is on the side of downstream in a main scanning direction and downstream in a sub scanning direction relative to exposure position of the laser light for drawing.

10. The record apparatus according to claim 9, wherein the laser displacement sensor is provided with the record head so that a center position of a spot on the record medium by applying the laser light for focus is distant 0.5 mm to 20 mm from a boundary of an image recorded area where the laser light for drawing is applied to a side of an image unrecorded area where the laser light for drawing is not applied.

11. The record apparatus according to claim 8, wherein each wavelength of the laser light for drawing and the laser light for focus and wavelength sensitivity characteristics of the record medium are set so that sensitivity of the record medium upon exposure of the laser light for focus is 50% or less of sensitivity of the record medium upon exposure of the laser light for drawing.

12. The record apparatus according to claim 8, wherein difference of wavelength between the laser light for focus and the laser light for drawing is 100 nm or more.

13. The record apparatus according to claim 8, wherein power of the laser light for focus is 50% or less of power of the laser light for drawing.

14. The record apparatus according to claim 8, wherein power density of the laser light for focus is 50% or less of power density of the laser light for drawing.

* * * * *